US005429050A

United States Patent [19]

Palmcrantz

[11] Patent Number: 5,429,050

[45] Date of Patent: Jul. 4, 1995

[54] ROLLER DEVICE

[75] Inventor: Jan Palmcrantz, Harmånger, Sweden

[73] Assignee: Scandrive I Hallstahammar AB, Kolback, Sweden

[21] Appl. No.: 301,242

[22] Filed: Sep. 6, 1994

[30] Foreign Application Priority Data

Sep. 7, 1993 [SE] Sweden ..... 9302893

[51] Int. Cl.[6] ..... B41F 31/26; B41F 31/13

[52] U.S. Cl. ..... 101/348; 101/DIG. 38

[58] Field of Search ..... 101/348, 349, 350, 351, 101/354, 148, DIG. 38

[56] References Cited

FOREIGN PATENT DOCUMENTS

93/06999 4/1993 WIPO .

*Primary Examiner*—J. Reed Fisher

*Attorney, Agent, or Firm*—McFadden, Fincham

[57] ABSTRACT

A roller device such as is used, e.g. as a distribution roller in an off-set printing machine, include an outer cylinder mounted in bearing units at opposed ends and is rotatable around and axis. At least one of the bearing units includes an inner cylinder, a casing built into the inner cylinder, which casing is rotatable via a gear by a rotation speed that differs from the rotation speed of the inner cylinder. A mechanism is provided which operates between the casing and the inner cylinder, for the purpose of converting the relative rotational movement between the casing and the inner cylinder into an axial reciprocal motion of the inner cylinder and thus also of the outer cylinder. The inner cylinder of the individual bearing unit is placed outside and is arranged to be co-rotatively carried by a pipe within which are provided two bearing sets which enable rotation of the pipe at a high speed relative to a stationary axle part, while at the same time the inner cylinder is axially movable forwards and backwards relative to the pipe without any substantial angular motion relative to the latter.

11 Claims, 4 Drawing Sheets

ROLLER DEVICE

TECHNICAL FIELD OF THE INVENTION

The present invention relates to a roller with an outer rotatable cylinder, such as is used, e.g. as a distribution roller in an off-set printing machine, include an outer cylinder mounted in bearing units at opposed ends and is rotatable around and axis. At least one of the bearing units includes an inner cylinder, a casing built into the inner cylinder, which casing is rotatable via a gear by a rotation speed that differs from the rotation speed of the inner cylinder. A mechanism is provided which operates between the casing and the inner cylinder, for the purpose of converting the relative rotational movement between the casing and the inner cylinder into an axial reciprocal motion of the inner cylinder and thus also of the outer cylinder. The inner cylinder of the individual bearing unit is placed outside and is arranged to be co-rotatively carried by a pipe within which are provided two bearing sets which enable rotation of the pipe at a high speed relative to a stationary axle part, while at the same time the inner cylinder is axially movable forwards and backwards relative to the pipe without any substantial angular motion relative to the latter.

More particularly, this invention relates to such a device where the cylinder, during its rotation, is movable forwardly and rearwardly in an axial direction and which at opposite ends is carried by bearing units. The bearing units are fastenable on a stand or the like and enable a rotation of said outer cylinder around a central geometric axis, with at least one of the bearing units having an inner cylinder co-rotatively connected to the outer cylinder. The inner cylinder is rotatable via bearings around an axle or axle-like part that is stationary relative to the stand.

A casing made up of the inner cylinder is rotatable via a gear, for instance an eccentric gear, with a rotation speed that differs, (although only slightly) from the rotation speed of the inner cylinder, actuating mechanism is provided between the casing and the inner cylinder for the purpose of converting the relative rotation or angular rotative motion between the casing and the inner cylinder into an axial reciprocal motion of the inner cylinder and thus, also of the outer cylinder. A seal means is connected to the inner cylinder of the individual bearing unit, for the purpose of keeping the interior of the inner cylinder separate from the surroundings of the cylinder.

In practice, rollers of the above general type are used as distribution rollers in off-set printing machines in order to mechanically work and level out the printing ink before it eventually reaches the printing plates roller, which roller effects the printing of the paper. The individual distribution roller is driven by being in abutment with at least one (direct or indirect) drive rollers in the machine. It is carried by those rollers and the axial reciprocating motion of the roller cylinder brings about a mechanical working-up and evening out of the ink layer in order to provide flawless printing. In web-offset printing machines, the distribution roller rotates, as do the other rollers, with relatively high rotation speeds, e.g., within the range of 1200 to 2000 revolutions per minute. In this connection, the frequency with which the roller moves axially must not be too high, as otherwise detrimental vibrations would occur. For this reason, it is necessary to keep the difference of rotation speeds between the aforementioned casing and inner cylinder at a comparatively low level.

BACKGROUND OF THE INVENTION

A known distribution roller of the above type is disclosed in SE-A-9102938-9. According to its construction, the inner cylinder comprising the conversion mechanism is, at opposite ends, provided with gables which are rotatably mounted in needle bearings outside a hollow axle. The axle, in the mounted form of the roller, is located at a central axis, the central axis is common for the two bearing units and is fixedly mounted in the stand of the machine at opposite ends. Outside the hollow axle, the casing is rotatably mounted in bearings in an axially fixed condition, the casing at one end having an external, eccentrically located gear rim with fewer cogs than a cooperating, internal gear rim on the inner cylinder. These two gear rims together form an eccentric gear that causes the rotational speed difference between the casing and the inner cylinder (more precisely, the casing rotates with a slightly higher speed than the inner cylinder).

The difference of rotational speeds, or the relative rotative motion, between the casing and the inner cylinder constitutes only a fraction, for instance a value within the range 1:10 to 1:60, of the true rotational speed of the roller cylinder during operation (1200 to 2000 rpm). At its opposite end, the casing has a circumferential, substantially sinusoidally curved groove in which a runner or follower operates. A ball bearing is provided, and the runner is connected with the inner cylinder. Jointly, the groove and the runner form a conversion mechanism which causes the inner cylinder, and thereby also the outer roller cylinder, to have a reciprocating axial motion when the casing rotates or turns relative to the inner cylinder, due to the eccentric gear. The interior of the inner cylinder, which is delimited by the gables, contains suitable lubricating means. In order to prevent the lubrication from forcing its way out and contaminating the machine and the paper web that passes through the machine, seals are arranged in the form of gasket rings which are placed outside the needle bearings and are in contact, with on one hand, the stationary hollow axle, and on the other hand with the pertaining cylinder gables.

The roller construction disclosed in SE-A-9102938-9 is advantageous insofar as its eccentric gear enables the inclusion of the desired motion conversion function and also in that the distribution rollers work with high rotational speeds. However, this construction is also associated with a number of disadvantages which make its practical use difficult. On such difficulty is due to the fact that the two bearing units are mounted on a common, relatively weak central axle, and not only with the outer gables of the inner cylinders, at a considerable distance from the sides of the machine stand from which the two opposite ends of the central axle are fastened. Therefore, in practice, the central axle tends to be subjected to a bending phenomena which make the needle bearings start to bind. Moreover, these needle bearings must simultaneously be capable of serving as radial and axial bearings in that they must on one hand, permit the inner cylinder to rotate with high speed (e.g. 2000 rpm) relative to the stationary hollow axle and on the other hand, permit an axial displacement of the inner cylinder forwards and rearwardly along the hollow axle. Therefore, it will be readily understood that even a small amount of bending of the central axle may quickly result in a binding phenomena, and damage to the needle bearings.

Another disadvantage is the necessity of using gasket rings which are submitted to frequent reoccurring axial motions at the same time as they function radially between an immovable component (the hollow axle) and a fast-rotating component (the inner cylinder). There are no seals accessible on the market which have a larger diameter and which are capable of simultaneously fulfilling these purposes in a satisfactory way. Therefore, leaks through the gasket rings may occur when the known roller has a large diameter.

Further, another shortcoming of the conventional roller is that it does not include any means for indicating malfunctions within the bearing units, at an early stage. There is thus a risk of sudden damage which could occur and which could easily lead to one or more adjacent rollers in the machine being damaged, if external arrangements are not provided for preventive purposes. Furthermore, the maximum load on the roller is restricted by the above mentioned sinusoidal groove and the runner serving as a carrier which serves to provide the required motion conversion function. For axial movements which are large relative to the diameter of the casing, an unfavourable motion pattern develops between the runner and the groove of the casing which results in an undesirable wear at high axial loads. In order to counteract this, relatively hard and difficult-to-machine materials should be used, which makes production expensive.

SUMMARY OF THE INVENTION

The present invention aims to overcome the above mentioned disadvantages of the roller construction disclosed in SE-A-9102938-9. Thus, a primary object of the invention is to provide a roller with great stiffness and with a stable mounting of the bearings, thus reducing their tendency to bend. Another object is to provide a roller without any components which are simultaneously submitted to high rotation speeds as well as to axial movements. Still another object is to provide a roller whose bearing units are constructed in such a way that they make possible the use of appropriate sealing components which guarantee a good sealing of the interior of the roller relative to the surroundings. It is also an object of the invention to form the bearing units of the roller so that indications of malfunctions within the bearing units may quickly be detected in an easy way. A further object is to provide a roller with a motion conversion mechanism which is simple and runs easily, and has a great load transfer capability at large diameters.

According to the invention, at least the primary object is attained by the features as defined by providing an apparatus in which there is an improvement described hereinafter. More particularly, according to this invention. In a roller structure device having an outer rotatable cylinder which, during its rotational movement, is movable forwards and rearwardly in an axial direction, and which at opposite ends is mounted by bearing units fastenable to a fixed member to enable rotation of the outer cylinder around a central geometric axis and in which at least one of the bearing units includes an inner cylinder member co-rotatively connected to the outer cylinder with the inner cylinder being rotatable through bearings around an axle member which is stationary relative to the fixed member, the device having a casing comprised of the inner cylinder rotatable via a gear having a rotational speed differing from the rotational speed of the inner cylinder, and a conversion mechanism actuating between the casing and the inner cylinder for converting the relative rotational or angular rotative motion between the casing and the inner cylinder into an axial reciprocal motion of the inner cylinder and consequently of the outer cylinder, seal means connected to the inner cylinder of each individual bearing unit for maintaining the interior of the inner cylinder separate from cylinder surroundings, the improvement wherein the inner cylinder of each bearing unit is positioned outside and arranged for rotatable mounting by pipe means, the pipe means having at least two axially separate interior bearings enabling high speed rotation of the pipe relative to the stationary axle member at the same time as the inner cylinder is axially movable forwardly and rearwardly relative to the pipe means without substantial angular rotation in relation to the pipe at least during normal operation, and wherein the seal means includes a seal between the inside of the inner cylinder and the outside of the pipe.

Other advantageous embodiments of the invention will be shown hereinafter.

Distribution rollers similar to the one in SE-A-9102938-9 are also described in DE-A-2 045 717 and in U.S. Pat. No. 2,040,331. These distribution rollers also have the above mentioned inconveniences. In U.S. Pat. No. 4,646,638, a rotating roller is disclosed, by which ink is transferred from the ends of the roller towards its centre, the roller being divided in two equally long units which are eccentrically mounted in bearings in relation to a geometrical rotation axis. Thus, this construction does not include any whole roller cylinder of the type which the present invention makes use.

DETAILED DESCRIPTION OF A PREFERRED EMBODIMENT OF THE INVENTION

Figure 1:
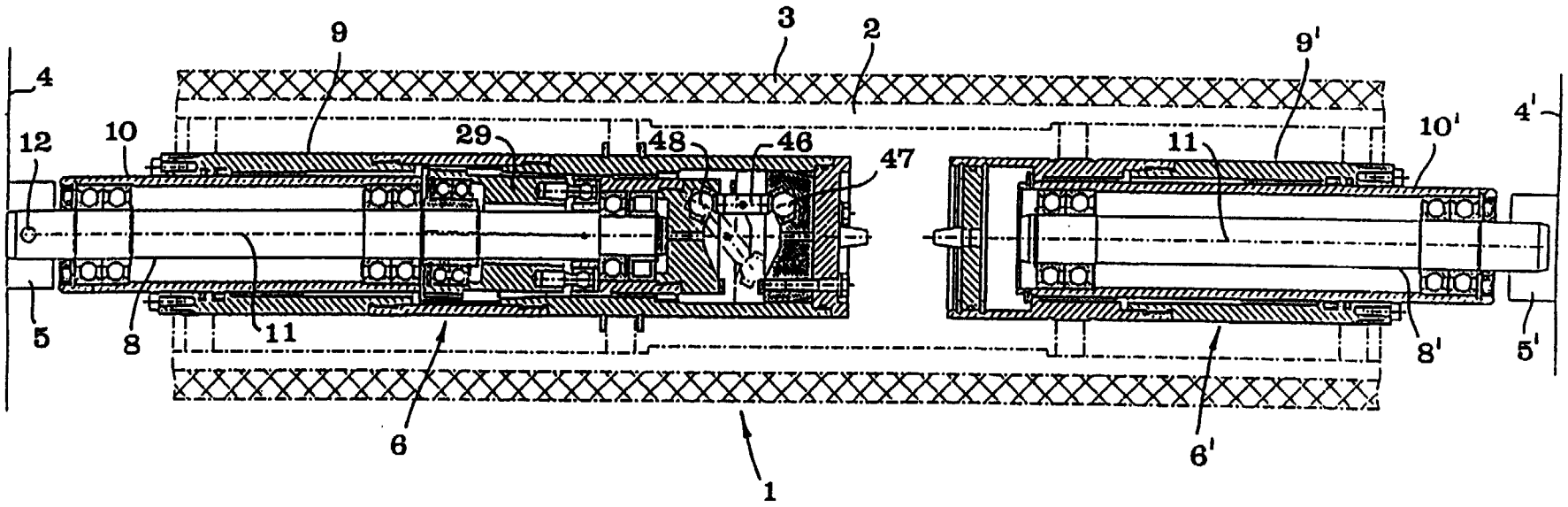
FIG. 1 is a longitudinal section through a roller according to the invention shown in a reduced scale in its entirety, mounted in a stand.

In FIG. 1, roller according to the invention is generally designated by reference numeral 1, which roller comprises an outer cylinder 2 made of, for instance steel, whose outer surface may be covered with a rubber-facing 3. The roller is mounted in a machine stand between opposite stand sides, indicated at 4,4'. The separate fasteners which carry roller 1 are indicated by 5 and 5'. Rotation of the roller is effected by contact of the envelope surface of the roller with one or several other rollers (not shown) associated with the machine. In, for instance, web-offset printing machines, this rotation takes place at relatively high rotation speeds, e.g. about 2000 rpm or even higher. It is characteristic for both the roller shown in FIG. 1 and the aforementioned known distribution rollers, that the outer cylinder 2 during rotation simultaneously performs an axial reciprocating movement in order to even out an ink layer located on the rubber envelope 3, in cooperation with the other rollers.

Roller 1 comprises two bearing units generally designated by reference numerals 6 and 6', respectively, the former of which comprises a conversion mechanism and a pertaining eccentric gear, while the latter lacks such a mechanism and works only as a bearing unit that carries the roller cylinder. The first bearing unit 6 is shown in enlarged scale in FIGS. 2 and 3, while bearing unit 6' is shown in detail in FIG. 4. Each bearing unit has an axle or axle-like part 8,8', an inner cylinder 9,9' which is concentric with this axle, and a pipe 10,10' arranged between the axle and the inner cylinder. Roller cylinder 2 is rotatable around a central, geometrical axis or rotation axle 11 which is common for the two bearing units 6,6'. Axle parts 8,8' which are suitably made in the form of solid axle journals, are stationary, i.e. non-rotatably mounted at the stand, as indicated by pin 12 in FIG. 1.

As may be clearly seen in FIG. 1, the two bearing units 6,6' are interconnected solely via outer cylinder 2 and not through any central axle.

Figure 2:
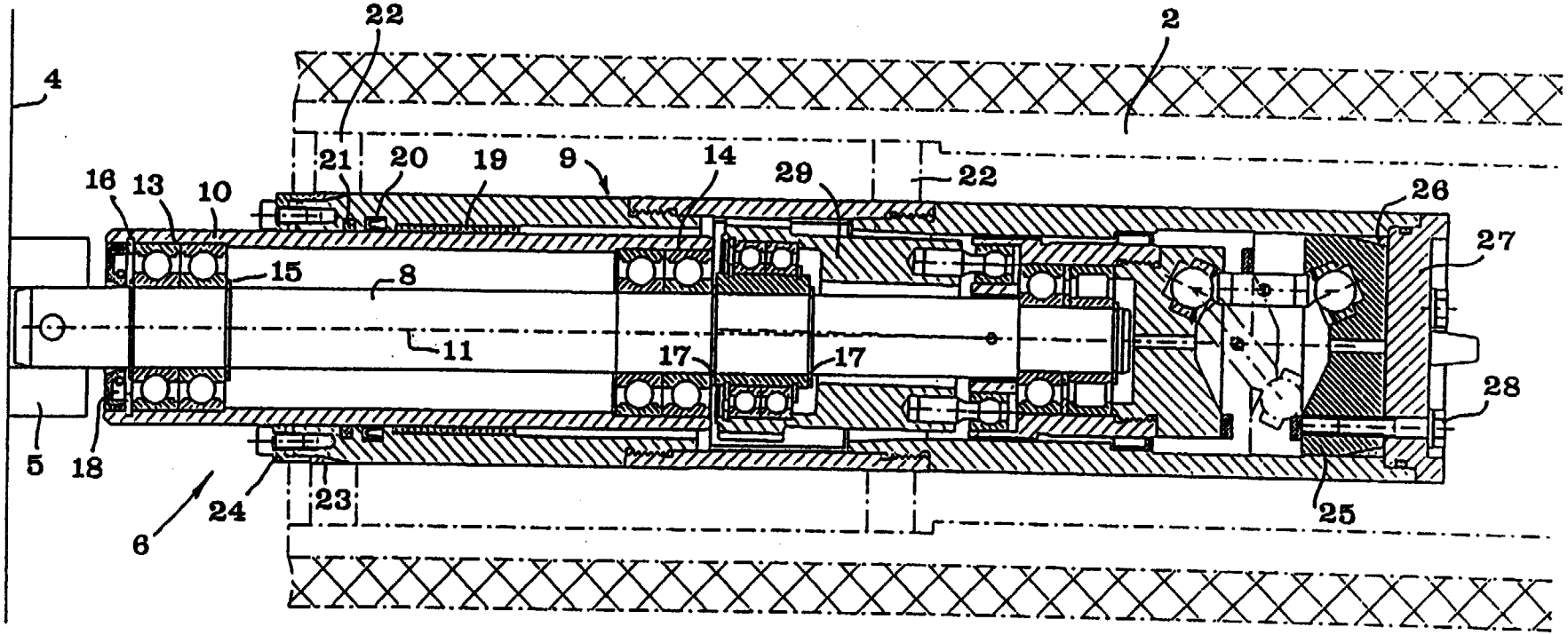
FIG. 2 is a partial longitudinal section showing a bearing unit having a roller, on an enlarged scale, the bearing unit being a motion conversion mechanism.
Figure 3:
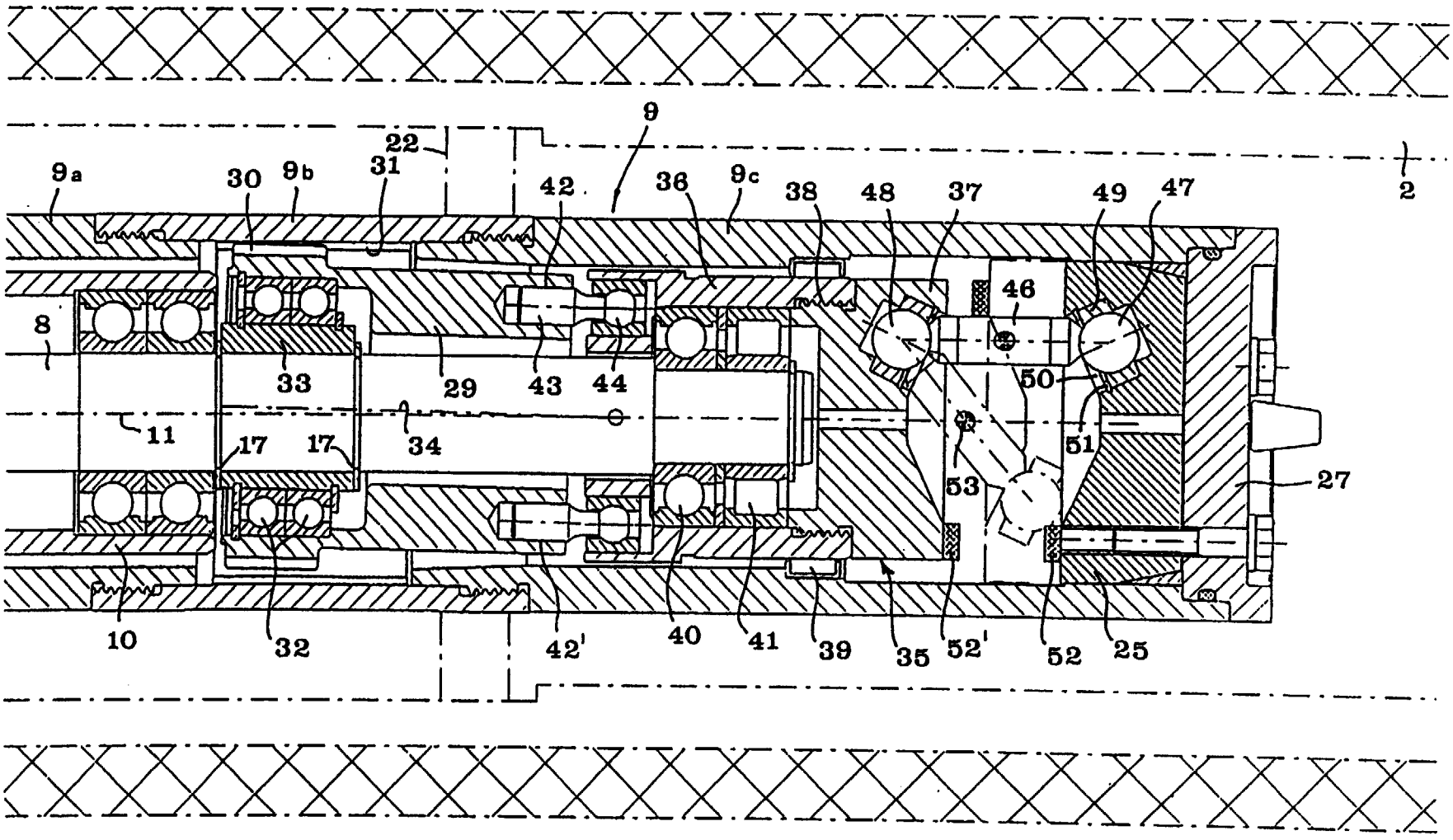
FIG. 3 is a partial longitudinal section showing the motion conversion mechanism in a further enlarged scale.

Reference is now made to FIGS. 2 and 3, which illustrate in more detail bearing unit 6. Two axially separate bearings or bearing sets 13,14 are arranged within pipe 10, which bearings or bearing sets are advantageously placed in the pipe end areas. In practice, ball bearings are preferred for the purpose, which in the example are shown in sets of two at each end of the pipe, although it is feasible to use single bearings at each pipe end. Bearing set 13 is held in place on axle 8 by conventional locking rings 15. Axial connection between the pipe 10 and bearing set 13 is achieved by a locking ring 16 in cooperation with a shoulder on the inside of the pipe. A radial gasket ring 18 is arranged in the area outside bearing set 13 at the outer, free end of pipe 10, suitably in the form of a "Simmer-ring". It should be noted that the free, outer end of pipe 10 is located in the immediate proximity of the stand fastener 5, which means that the part of axle 8 that extends from the stand fastener 5 to bearing set 13 is very short (in practice only a few millimeters).

In the area of its outer fee end, inner cylinder 9 is arranged, with a comparatively snug fitting, relative to pipe 10. A bushing 19, for instance a plastic bushing, is located at some distance from the cylinder end, the bushing 19 being fastened in a suitable way on the inner cylinder and abutting (with frictional contact) against the envelope surface of pipe 10. Furthermore, a gasket ring 20 is arranged in a circumferential groove on the inside of inner cylinder 9, which ring is shown cross-sectionally as a V-formed ring in FIG. 2, although it may also be in the form of a conventional O-ring. Moreover, a coarse-separation seal 21 is arranged in a circumferential groove on the inside of the inner cylinder, in the area outside gasket ring 20, for instance in the form of a Teflon coated string which prevents or reduces the intrusion of, for instance, paper fibres or other solid particles in the direction of seal 20.

Inner cylinder 9 is held in place in a centered position in relation to outer cylinder 2 by a number of ring flanges 22 on the inside of the outer cylinder. Inner cylinder 9 is axially locked relative to the outer cylinder by a conical ring 23 which is tightened between the inside of outer ring flange 22 and a conical surface on the outside of inner cylinder 9 by a presrewable retaining ring 24.

At its inner end, inner cylinder 9 has a gable wall or part 25 which is fixedly held in place by a conical ring 26, which may be squeezed between the internal cylinder surface of the inner cylinder and a conical surface on the outside of gable member 25 by a retaining plate 27. The latter is tightenable by a suitable number of screws 28. Thus, gable member 25 is fixedly connected to inner cylinder 9, not only in a rotation direction, but also in an axial direction.

A casing 29 is arranged within inner cylinder 9 (see FIG. 3), which casing in a conventional manner, is provided with an outer cog-ring or cog-track 30 arranged to cooperate with an internal cog-ring 31 on the inside of inner cylinder 9. In this context, it may be pointed out that inner cylinder 9 is divided into three sections 9*a*, 9*b* and 9*c*, which are interconnected via thread joints. The internal cog-ring 31 is provided on the inside of the middle cylinder section 9*b*, which has a smaller wall thickness than the adjacent sections 9*a*,9*c*. It should also be noted that the outer cog-ring 30 on casing 29 has a smaller axial extension than cog-ring 31. Casing 29 is mounted in bearings relative to the part of axle 8 which projects in a direction inwardly from pipe 10, in this case via a bearing set consisting of two ball bearings 32. The bearings are arranged outside an eccentric ring 33 located on the axle, the thickest part of the ring in this example being shown above axle 8 with the diametrically opposite, weaker section being shown below the axle. Eccentric ring 33 is held in place by locking rings 17. Cog-ring 30 is made with fewer cogs than cog-ring 31 (cog-ring 31 has at least one cog more than cog-ring 30). When casing 29 rotates relative to axle 8, it will perform an eccentric rotational motion in relation to central axis 11, more specifically in such a way that the axis of symmetry 34 of the casing, which axis forms a given angle V° relative to axis 11, will vary as a generatrix around an imaginary, very narrow cone. The cog engagement between cog tracks 30,31 will therefore travel along cog track 31, whereby the inclined casing and the cog-rings in a conventional manner, (for instance as disclosed in SE-A-8700291-1), form an eccentric gear. The gear, with rotating inner cylinder 9, brings casing 29 to rotate with each other, and in practice at a higher rotation speed than the cylinder itself. This difference in rotational speeds can be established by a suitable choice of the numbers of cogs in the cog tracks 30,31. Thus, as an example, inner cylinder 9 (which is co-rotatively joined with the main roller cylinder 2) may rotate at 2000 rpm. At this rotational speed, the number of cogs in the eccentric gear is chosen so that casing 29 rotates with 2040 rpm, so that a relative rotational motion r turning angular motion will arise between the inner cylinder and the casing, whose rotation speed amounts to 40 rpm. Since the function of the eccentric gear is previously described in detail (for instance SE-A-8700291-1), it will not be further clarified here.

Casing 29 is co-rotatively joined via flexible coupling to a cover designated, in its entirety, by reference numeral 35 which is composed of a cylindrical member 36 and a gable wall or gable member 37. These two cover parts 36,37 are interconnected by a thread joint 38. On its outside, cover member 35 is mounted in a needle bearing 39 relative to inner cylinder 9. In relation to axle 8, cover 35 is mounted via a bearing set which, in the present case, includes on one hand, a ball bearing 40 and on the other hand a roller bearing 41. The coupling between cover 35 and casing 29 is formed by a number of peripherically evenly distributed bodies; in the example shown having two diametrically opposed bodies 42,42', each one has on one hand a cylindrical portion 43 which is axially movably mounted in a correspondingly cylindrical seating at the end of the casing 29 facing the cover. On the other hand, a ball body 44 which is accommodated in a partial spherical cavity in a ring 45, is in turn placed in a seat in the end of cover 35 facing casing 29. By this coupling arrangement 42,42' a co-rotative connection is achieved between casing 29 and cover 35, so that these always rotate with the same rotational speed. It should be noted that the cover rotates concentrically around the central geometric axis 11 of the roller, while casing 29 rotates around its own axis of symmetry 34 which is inclined in relation to centre axis 11. Further, it should be observed that cover 35 is axially locked relative to axle 8 by bearings 40,41 and the respective locking ring and shoulder.

A link 46 is provided between the gable wall 25 of inner cylinder 9 and gable member 37 of cover 35, which link is articulatedly or hingedly connected with the respective components via first and second joints 47,48. As may be seen in FIG. 3, joints 47,48 are eccentrically placed relative to the rotational axis 11 of the roller, suitably at equally spaced radial distances from this centre axis. Advantageously, the individual joints 47,48 are each formed by a sphere which is fixedly connected to the link. The sphere is accommodated in a partial spherical cavity in a ring 49, which is stationarily mounted in a seat 50 by, retaining members 25 and 37, respectively, and is held secure by a locking ring 51. In order to compensate for the mass represented by link 46 and to avoid any vibration, two equally large or equally heavy counterweights 52,52' are arranged on members 25,37. These identical or equally large counterweights are placed in positions which are diametrically opposed to joints 47 and 48, respectively. The counterweights are chosen in such a way that they jointly outbalance the mass of link 46 when the link, as shown in FIG. 3, assumes a position parallel to centre axis 11 (in which parts 25,37 are maximally distanced from each other). When members 25,37 rotate or turn in relation to each other, as will be further described below, counterweights 52,52' will also turn so that counterweight 52 takes a position diametrically opposed to counterweight 52' when joints 47,48 are located diametrically opposed to each other in the position shown by dash-dotted lines, in which position the centre of gravity marked 53 of the link is situated exactly along centre axis 11. Under a condition where the size and position of counterweights 52,52' are correctly selected, the mass of the system formed by the link and the counterweights will always have its centre of gravity located along centre axis 11, independently of the angular position between parts 25,37. Thus, providing the counterweights, it is evident that the link, when eccentrically placed relative to axis 11, will not give rise to any unbalanced condition that may cause vibration.

Figure 4:
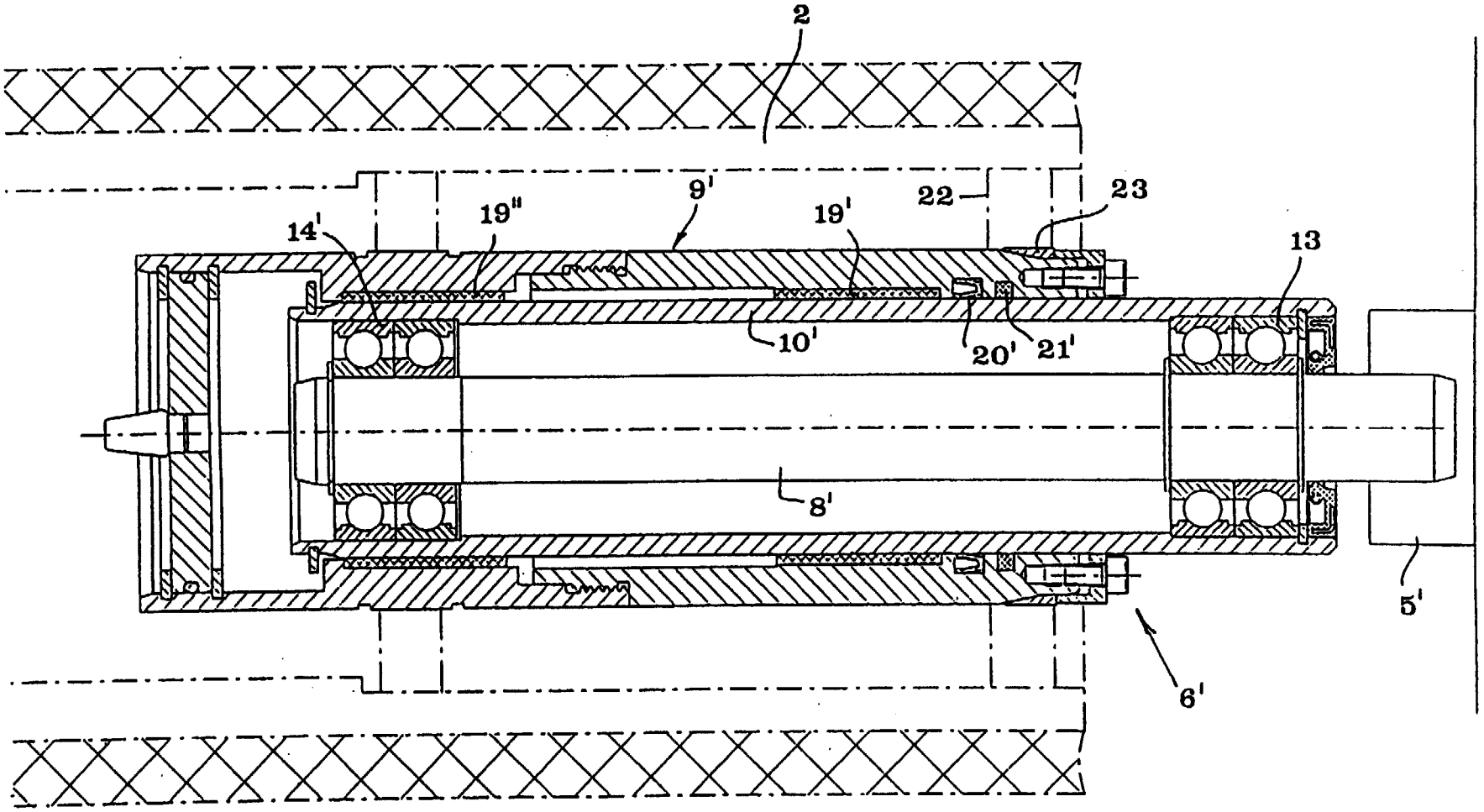
FIG. 4 is a partial longitudinal section through the other bearing unit of the roller, without any conversion mechanism.

Bearing unit 6' which is shown in enlarged scale in FIG. 4, has the same fundamental construction as bearing unit 6 with the exception of not having an eccentric gear and a motion conversion mechanism. Thus, inner cylinder 9' is also arranged outside a pipe 10', which has a significantly larger diameter than the central axle part 8' and which is mounted in relation to it by sets of outer and inner bearings 13' and 14', respectively. Also, at this bearing unit, inner cylinder 9' carries inner pipe 10' via one or several bushings 19', 19'', preferably made of suitable plastic. Bearing unit 6' also has an axial seal 20', a coarse-separating seal 21' and a conical ring 23' for fastening the axle unit to the outer cylinder 1.

When the outer, very stiff roller cylinder 2 is rotated (with e.g. 2000 rpm) by one or several abutting, cooperating rollers, the two inner cylinders 9,9' of the bearing units will also rotate with the same rotation speed. By frictional contact of bushings 19,19', 19'' with pipes 10,10' (which are freely and easily rotatable relative to the stationary axle parts 8,8') pipes 10,10' will be brought into rotational motion with at least approximately the same rotational speed as the inner cylinders 9,9' (a certain slippage is in any event acceptable). The eccentric gear formed by casing 29 and cog-rings 30,31 provides for the fact that cover 35 not only is carried by inner cylinder 9, but also is given a certain speed contribution (e.g., 40 rpm). This provides for a relative rotational motion being brought about between cover 35 and the gable member 25 which is co-rotatively connected to inner cylinder 9.

In relation to the high rotational speed of the roller, the rotational speed of this relative rotational motion is very modest (it should amount to max. 1:10 , suitably 1:20–1:60). When cover 35 rotates in this way with a moderate rotation speed relative to gable member 25, link 46 will alternatingly decrease and increase the axial distance between cover 35 and gable member 25, as is clearly illustrated in FIG. 3, showing that inner cylinder 9 will move forwardly and rearwardly relative to pipe 10. In turn, this means that outer cylinder 2 and inner cylinder 9' relating to the other bearing unit 6' will move in an analogous manner in an axial direction.

A fundamental advantage of the invention is that the roller does not have any components that are simultaneously submitted to both high rotational speeds and axial movements. It is true that the radial seal 18 works between the immobile axle part 8 and the fast-rotating pipe 10, but there are no axial movements whatsoever between the pipe and the axle member at the same time as the seal works against a relatively weak axle, whereby the tangential speed, and thus the wear are limited. Seal 20 is submitted to axial movements but at least during normal operation, no substantial rotational speed difference between pipe 10 and inner cylinder 9 arises. In other words, the two seals 18,20 may be made in a well-adapted way in order to solely fulfill the functions of sealing radially and axially.

Another advantage of the invention is that the bearing of the roller is very stable due to the fact that the inner cylinders 9,9' of the roller are arranged on the outside of intermediate pipes 10,10' which are capable of accommodating relatively heavy bearings, e.g. in the form of ball or roller bearings, and which do not need to take up axial movements. The stable bearing of the roller also contributes to a large extent to the fact that the distances between the stand fastenings 5,5' in question and the outer bearings 14,14' of the roller are very small, so that axle parts 8,8' extend freely suspended for only a very short distance. Therefore, the bending tendency of the roller is mainly determined exclusively by outer cylinder 2, which has significant stiffness due to its large diameter. A special advantage is achieved by arranging the inner cylinder of the individual bearing unit outside an intermediate pipe which, in turn, is mounted in bearings relative to the appropriate stationary axle part. Thus, it is possible to provide the inner cylinder and the pertaining pipe with markings, e.g. scribed marks, whose direction of rotation may be registered, for instance by a pulse scaler, so that any possible noticeable angles of rotation between the inner cylinder and the pipe are detectable. Therefore, if it occurs that a bearing or another component would start binding or become defective in any other way, so that the pipe no longer is easy-running which is carried by the inner cylinder at the friction joint of the bushing, then the commencement of the malfunction may be quickly discovered by detecting the change in angle of rotating between the inner cylinder and the pipe. Then, the machine may be stopped at an early stage for a replacement or a control of the roller in question. In this way, the risk that an individual roller suddenly breaks down totally and demolishes one or several other rollers in the machine is eliminated.

It is evident that the invention is not restricted solely to the embodiment as described and shown in the drawings. Thus, it is feasible to apply the invention to other rollers with other types of motion conversion mechanisms through a link, although the described link is preferred in practice. Eventually it may be noted that the invention is usable not only at such distributing rollers that are used in printing machines, but also at any other type of roller, in relation to which there is a need to set the roller in axial motion at the same time as it rotates.

I claim:

1. In a roller structure device having an outer rotatable cylinder which, during its rotational movement, is movable forwards and rearwardly in an axial direction, and which at opposite ends is mounted by bearing units fastenable to a fixed member to enable rotation of said outer cylinder around a central geometric axis and in which at least one of the bearing units includes an inner cylinder member co-rotatively connected to said outer cylinder with said inner cylinder being rotatable through bearings around an axle member which is stationary relative to said fixed member, said device having a casing comprised within said inner cylinder rotatable via a gear having a rotational speed differing from the rotational speed of the inner cylinder, and a conversion mechanism actuating between the casing and the inner cylinder for converting the relative rotational or angular rotative motion between said casing and said inner cylinder into an axial reciprocal motion of the inner cylinder and consequently of said outer cylinder, seal means connected to said inner cylinder of each individual bearing unit for maintaining the interior of said inner cylinder separate from cylinder surroundings, the improvement wherein said inner cylinder of each bearing unit is positioned outside and arranged for rotatable mounting by pipe means, said pipe means having at least two axially separate interior bearings enabling high speed rotation of said pipe means relative to said stationary axle member at the same time as said inner cylinder is axially movable forwardly and rearwardly relative to said pipe means without substantial angular rotation in relation to said pipe means at least during normal operation, and wherein said seal means includes a seal between the inside of the inner cylinder and the outside of said pipe means.

2. A roller device according to claim 1, including at least one bushing arranged between the inside of said inner cylinder and the outside of said pipe for mounting said pipe means to have substantially the same rotational speed as said inner cylinder.

3. A roller device according to claim 1, wherein when said roller is in a mounted state, the outer end of said pipe means is located in an immediate proximity of a portion of a stand carrying said roller.

4. A roller device according to claim 1, wherein a radial seal is positioned outside an outer bearing at an end of said pipe means turned towards said fixed member.

5. A roller device according to claim 1, wherein said two bearing units are interconnected solely via said outer cylinder.

6. A roller device according to claim 1, wherein said conversion mechanism comprises link means articulatedly connected in the area of its opposed ends to, on one hand a member co-rotatively connected to the inner cylinder and on the other hand, to said casing, said link means alternatively decreasing and increasing the axial distance between said casing and said inner cylinder when said casing and said inner cylinder rotate or turn relative to one another.

7. A roller device according to claim 6, wherein said link means includes joint members eccentrically located relative to the geometrical rotational axis of said roller, and wherein each of said members have a corresponding equally large counterweight which are diametrically opposed to said joint members to outbalance the mass moment of said link means around the geometrical rotation axis of said roller independently of the angular position of said casing and said inner cylinder relative to each other.

8. A roller device according to claim 7, wherein each joint member is comprised of a sphere, said sphere being of the link means and being accommodated in a partial spherical cavity in a ring mounted in a seat in said casing and said inner cylinder and is held in place by a locking ring.

9. A roller device according to claim 6, wherein said member connected to said inner cylinder comprises a gable of said inner cylinder.

10. A roller device according to claim 6, having a member connected to said casing comprising a cover means mounted by bearings relative to both said inner cylinder and said axle member, said cover being connected to the said casing via a coupling whereby said casing can rotate eccentrically relative to said central geometric axis of said bearing units while said cover means rotates centrically relative to said central geometric axis.

11. A roller device according to claim 1, wherein said conversion mechanism comprises link means articulatedly connected in the area of its opposed ends to, on one hand a member co-rotatively connected to the inner cylinder and on the other hand, to a rotatable member co-rotatively connected to said casing, said link means alternatively decreasing and increasing the axial distance between said casing and said inner cylinder when said casing and said inner cylinder rotate or turn relative to one another.

* * * * *